US005201462A

United States Patent [19]

Sada et al.

[11] Patent Number: 5,201,462

[45] Date of Patent: Apr. 13, 1993

[54] LIQUID CONTAINER

[75] Inventors: Jun Sada; Yoshiaki Take; Toshihide Togi; Masatoshi Fujima; Masahiro Uematsu; Takashi Ito; Rie Hirahara; Makoto Igarashi; Nobumasa Yamazaki, all of Tokyo, Japan

[73] Assignee: Toppan Printing Co., Ltd., Tokyo, Japan

[21] Appl. No.: 853,054

[22] Filed: Mar. 18, 1992

[30] Foreign Application Priority Data

| | | | |
|---|---|---|---|
| Mar. 19, 1991 | [JP] | Japan | 3-23782[U] |
| Mar. 19, 1991 | [JP] | Japan | 3-32783[U] |
| Jun. 11, 1991 | [JP] | Japan | 3-52307[U] |
| Jul. 31, 1991 | [JP] | Japan | 3-67342[U] |
| Oct. 25, 1991 | [JP] | Japan | 3-95857[U] |
| Nov. 12, 1991 | [JP] | Japan | 3-295814 |
| Jan. 20, 1992 | [JP] | Japan | 4-5784[U] |

[51] Int. Cl.[5] ..... B65D 43/06

[52] U.S. Cl. ..... 229/125.15; 220/403; 220/463

[58] Field of Search ..... 229/125.15, DIG. 4, 229/134; 220/460, 461, 462, 463, 403, 404, 465; 222/23, 105, 92, 183

[56] References Cited

U.S. PATENT DOCUMENTS

| | | | |
|---|---|---|---|
| 3,132,789 | 5/1964 | Forrest | 220/462 |
| 3,233,817 | 2/1966 | Casady | 220/403 |
| 3,921,897 | 11/1975 | Noyes et al. | 220/460 |
| 4,032,053 | 6/1977 | Wilson | 229/DIG. 4 |
| 4,165,023 | 8/1979 | Schmit | 222/105 |
| 4,565,315 | 1/1986 | Wagner et al. | 220/460 |
| 4,572,422 | 2/1986 | Hueberger et al. | 220/461 |
| 4,801,080 | 1/1989 | Spengler | 229/134 |
| 5,048,691 | 9/1991 | Hueberger et al. | 220/462 |
| 5,114,069 | 5/1992 | Detzel et al. | 229/125.15 |

*Primary Examiner*—Allan N. Shoap
*Assistant Examiner*—Christopher McDonald
*Attorney, Agent, or Firm*—Armstrong, Westerman, Hattori, McLeland & Naughton

[57] ABSTRACT

A liquid container having a carton and an inner bag within the carton, the carton having foldable portions, wherein a metering unit of a cap attached to a spout does not interfere with the foldable portion to thereby permit a liquid in the container to be metered. The carton has an upper side tilted plate from which the spout protrudes outward. Each foldable portion is provided between the tilted plate and each of a front plate and a rear plate which cooperates with a pair of side plates to constitute a barrel of the carton. Each foldable portion has a cutout therein to avoid interference with the metering unit.

7 Claims, 20 Drawing Sheets

LIQUID CONTAINER

BACKGROUND OF THE INVENTION

1. Field of the Invention

The present invention relates to liquid containers which are called so-called bag-in-box containers including a carton and an internal bag provided in the carton with a spout protruding from inside the carton.

2. Background Art

Conventionally, liquid containers are disclosed, for example, in U.S. Pat. No. 4,572,422 and Japanese patent laid-open publication No. 60-99870. As shown in FIG. 29, the liquid container 1 includes a substantially block-shaped carton A having a partial upper tilted plate with a spout a thereon. As shown in FIG. 30 which illustrates an open upper end of the carton, a foldable portion 6 including two continuous triangular flaps 5 is provided between the upper tilted side plate 2 from which the spout a connected to the inner bag b provided within the carton protrudes outward and each of a front plate and a rear plate 3, 4 (in FIGS. 29, 30, the rear plate 4 (not shown) is behind the front plate 3 to thereby facilitate the assembling of the carton and securely accommodate the bag within the carton with the tilted plate.

The carton A will be described using its expanded blank B. As a carton of this type, a longitudinal block-like one is used. As shown in FIG. 31, the blank B includes a side plate 7, a rear plate 4, a side plate 8 and a front plate 3 as the four side walls constituting the barrel of the carton, and bottom flaps 9, 10, 11, 12 connected to the corresponding lower edges of the sidewalls to constitute the carton bottom. Top flaps 13, 14, 15, 16 constituting the carton top are provided as continuous to at upper edges of the side plate 7, rear plate 4 and tilted plate 2 connected to the side plate 8, and the front plate 3, respectively.

Reference numeral 17 denotes an overlap width provided at a side edge of the side plate 7. The triangular portion connecting between the tilted plate 2 and each of the front and rear plates 3 and 4 constitutes the foldable portion 6 with a line 18 along which the foldable portion is foldable.

A sleeve-like carton is made of a blank of this type. A synthetic resin inner bag forming tube with a spout is placed at a predetermined position in the blank, and bonded at sections 19 shown in FIG. 31. The overlap width 17 of the blank B is then bonded to the outer edge of the front plate 3 to provide a sleeve-like carton with the internal bag forming tube therein. The tube is hermetically sealed at their upper and lower edges to form a complete internal bag, and the bottom and top of the carton with the upper side tilt plate 2 are then formed to provide the liquid container 1. In some cases, when the internal tube is bonded, the internal tube beforehand hermetically sealed at their upper and lower edges is bonded. Reference numeral 20 of FIG. 31 denotes a hole to which the spout a is fitted. FIG. 32 shows a liquid container 1 with a cap c attached to the spout.

The contents of the container (for example, a liquid detergent) can be used by metering a quantity of the content to be poured. In these days, a cap with a metering unit is used in a container containing such contents.

When a regular cap is attached to the conventional liquid container, there are no problems. However, when a cap c is to be used having a metering unit d protruding into the inner bag through the spout when set, as shown in FIG. 29, and especially when the diameter of the metering unit is large, the foldable portion is folded inwardly to protrude, and the folded portion becomes an obstacle to the metering unit to thereby hindering the insertion and fixing of the cap. In the carton itself, if the upper side tilted plate is bent to form the top of the carton, the foldable portions are folded inwardly. In this case, since the foldable portions are solely, triangular and continuous to the upper tilted plate and each of the front and rear plates as shown and described above, it cannot easily be folded inwardly. Thus, lower parts of the foldable portions where folding lines collect can be broken away, the upper tilted plate can be raised by insufficiently folded foldable portion and thus a spacing would occur undesirably between the upper tilted plate and each of the front and rear plates.

SUMMARY OF THE INVENTION

It is an object of the present invention to provide a liquid container including a carton with a foldable portion which is easily folded, and which does not interfere with a protruding portion of the metering unit of the cap attached to the spout to thereby meter the contents of the container with the metering unit for economic use.

In order to achieve the above object, according to the present invention, there is provided a liquid container comprising:

a carton including a front plate, a rear plate, a pair of side plates each connecting adjacent side edges of the front and rear plates, and an upper side tilted plate;

an inner bag disposed in the carton;

a spout protruding outward from said upper side tilted plate;

a pair of foldable portions each disposed between the upper side tilted plate and each of the front and rear plates, each foldable portion having a cutout.

As mentioned above, in the present invention, the foldable portion of the carton is easily folded. Although the metering, unit with the cap attached thereto protrudes into the bag through the spout, the protruding metering unit does not interfere with the foldable portion because the foldable portion is cut away at its portion corresponding to the metering unit.

It is another object of the present to make easy determination about whether the inner bag forming tube is bonded at an appropriate position to the blank in the manufacture of such container.

According to the present invention, there is also provided a liquid container comprising a sleeve-like carton which includes a blank and an inner bag tube attached to the blank; wherein at least one of top flaps forming the top of the carton and at least one of bottom flaps forming the bottom of the carton have on each of side ends thereof three line segment marks indicative of an upper limit, a middle position and a lower limit of an allowable range of the upper and lower positions of an inner bag forming tube bonded to said carton, the carton being made of a blank and taking the form of a sleeve formed by bonding, the marks being used when the blank with the inner bag forming tube being bonded to the blank is bonded so as to form the carton.

In this invention, since the blank and the line segment marks are stamped out by the same stamping die, the line segment marks are provided at all times at a predetermined position relative to the blank. Thus, by the positional relationship between the line segment marks on the sleeve-like carton which is flat after the formation of the sleeve tube and the upper and lower edges of the internal bag tube, it is easily determined whether bonding of the tube is satisfactory or not.

DETAILED DESCRIPTION OF THE PREFERRED EMBODIMENTS

Figure 1:
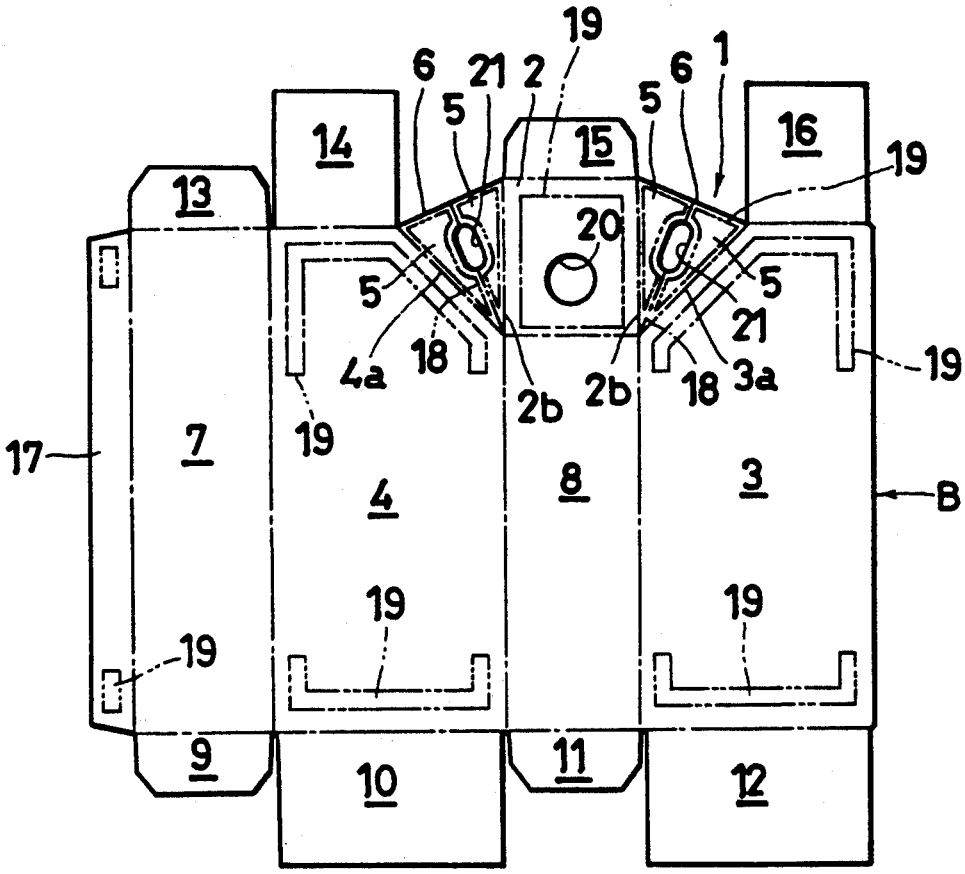
FIG. 1 illustrates the expansion of a carton in an embodiment of a liquid container according to the present invention.

Embodiments of the present invention will be described in detail with reference to FIGS. 1-28. The same reference numeral is given to identify the same element in the inventive and conventional containers and further description thereof will be omitted.

FIG. 1 shows a blank B obtained by expanding a carton of the liquid container. In the present invention, as shown, two foldable portions 6, one provided between an upper side tilted plate 2 and each of the front and rear plates 3 and 4, have a cutout 21 at a position corresponding to a metering unit of a cap and aligning with a central folding line 18. These cutouts 21 are stamped in substantially the form of an ellipse. Reference numeral 19 denotes bonding regions to which an internal bag b is bonded fixedly.

Figure 2:
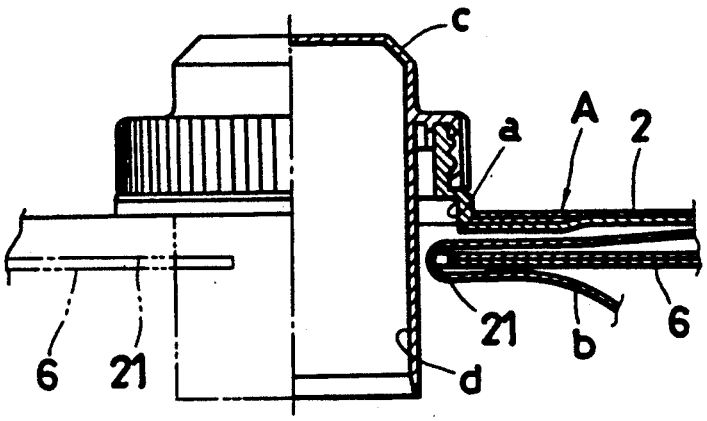
FIG. 2 illustrates a metering unit of a cap and a foldable portion of the container in a partial cross-sectional view.

As shown in FIG. 2, when the cap c is attached to a spout a, the foldable portions 6 are folded toward the side of the metering unit d. Cutouts 21 exist at a position corresponding to the metering unit d and the foldable portions 6 avoid the metering unit d, so that the foldable portions 6 and the metering unit d do not interfere with each other.

Figure 3:
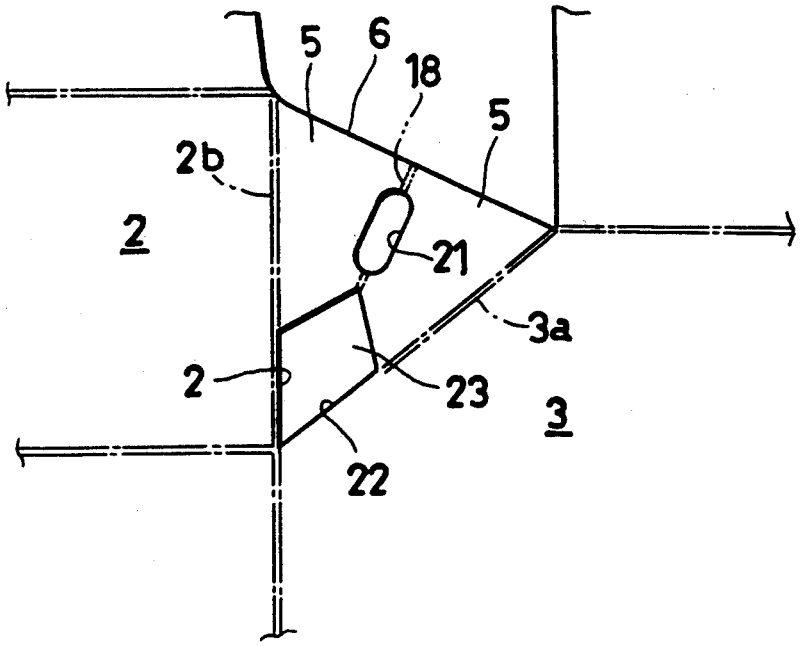
FIG. 3 illustrates the essential portion of a second embodiment on an enlarged scale.
Figure 4:
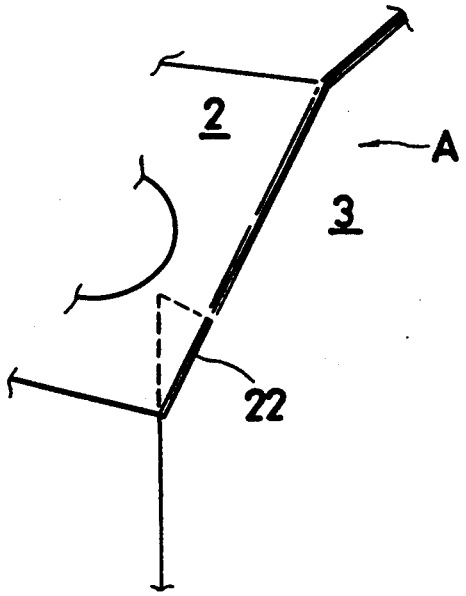
FIG. 4 illustrates an overhanging portion of the front plate in the second embodiment.

FIG. 3 shows a second embodiment in which the same portion as the foldable portion in FIG. 1 is illustrated on an enlarged scale. In this embodiment, a substantially rhombic, cutout 23 is formed such that one vertex of the rhombus coincides with the corresponding vertex of the foldable portion 6; the diagonal vertex is on a lower end of the folding line 18 below the cutout 21; one side of the rhombus extending from the first-mentioned vertex coincides with a side edge 2*a* of the upper side tilted plate 2 and a side 22 extends parallel to the side 3*a* of the foldable portion 6 from substantially the first-mentioned vertex and overhangs toward the cutout 23 by a least the thickness of the carton material from the side 3*a* of the foldable portion 6. The sides 2*a* and 22 are the same in length. Since the cutout 23 and the side 22 are provided, folding is easy and breakage of the carton material due to collection of folding lines is prevented when the carton is assembled. Furthermore, the side 2*a* of the tilted plate 2 forming part of the periphery of the cutout 23 does not appear laterally to thereby improve an appearance. As shown in FIG. 4, when the carton A is assembled, the formation of a raise due to collection of the folding lines is prevented and the side 2*a* is hidden by the overhang side 22.

Figure 5:
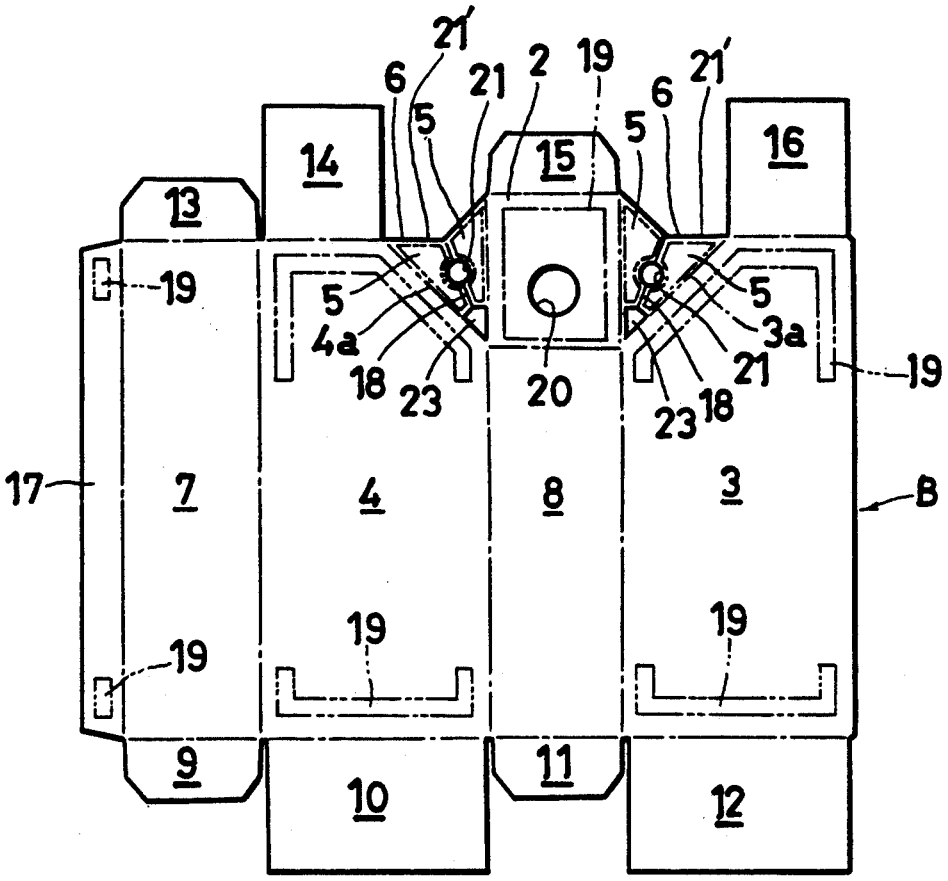
FIG. 5 illustrates an expanded carton blank where the foldable portion has a substantially V-like concave upper edge.
Figure 6:
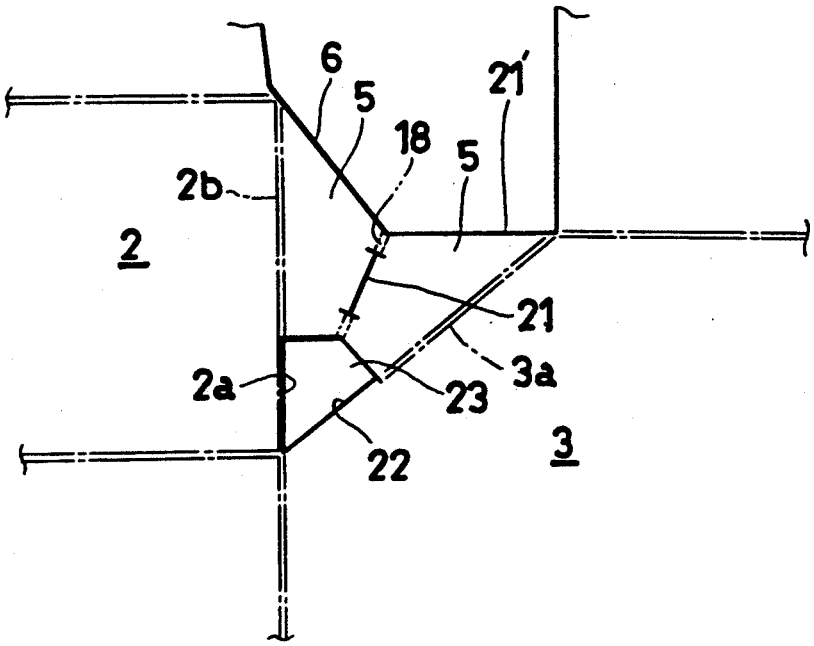
FIG. 6 illustrates a foldable portion of the carton with a substantially I-like cut.
Figure 7:
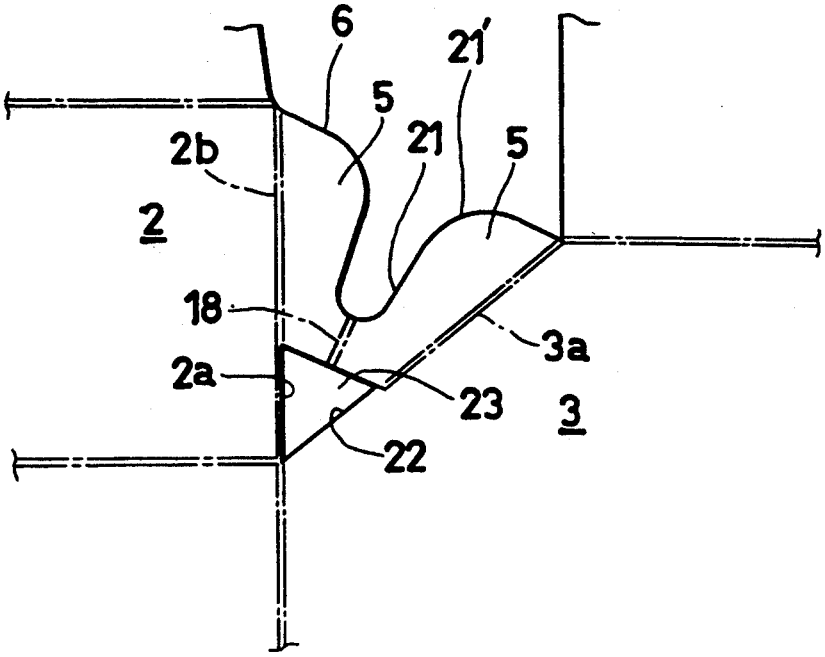
FIG. 7 illustrates a foldable portion with a large notch on its upper edge.
Figure 8:
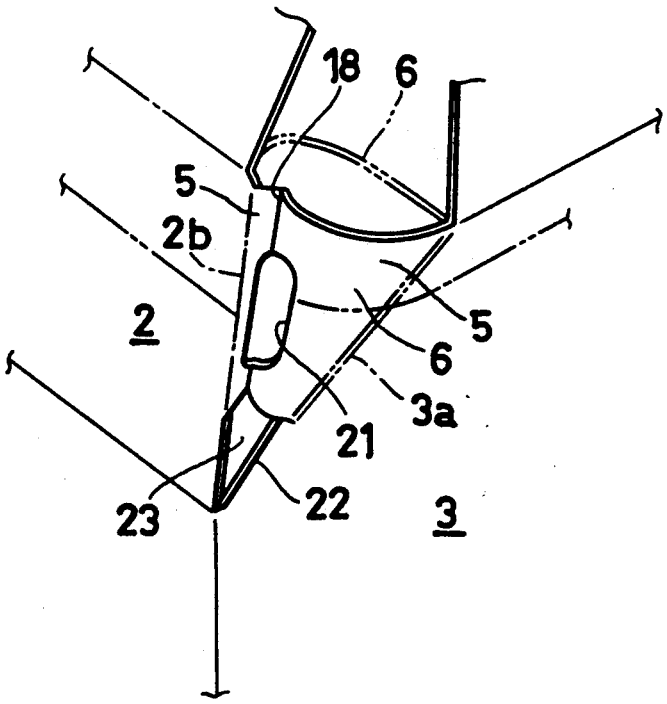
FIG. 8 illustrates a half-folded upper side tilted plate.
Figure 9:
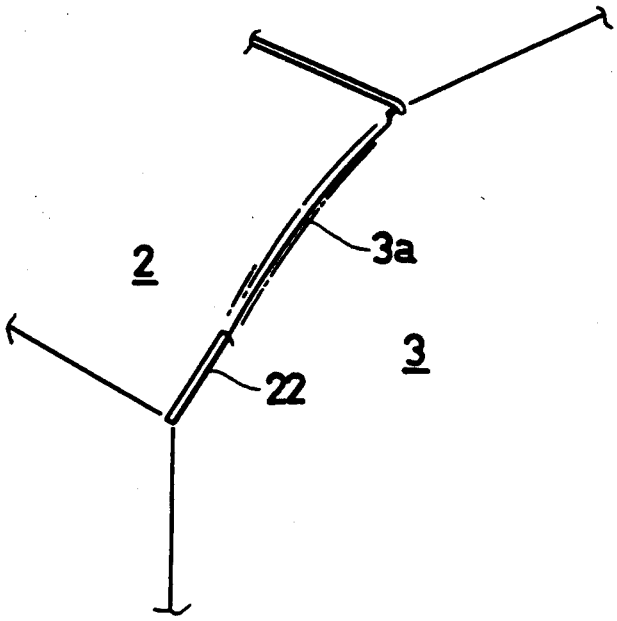
FIG. 9 illustrates a curved folded line.
Figure 10:
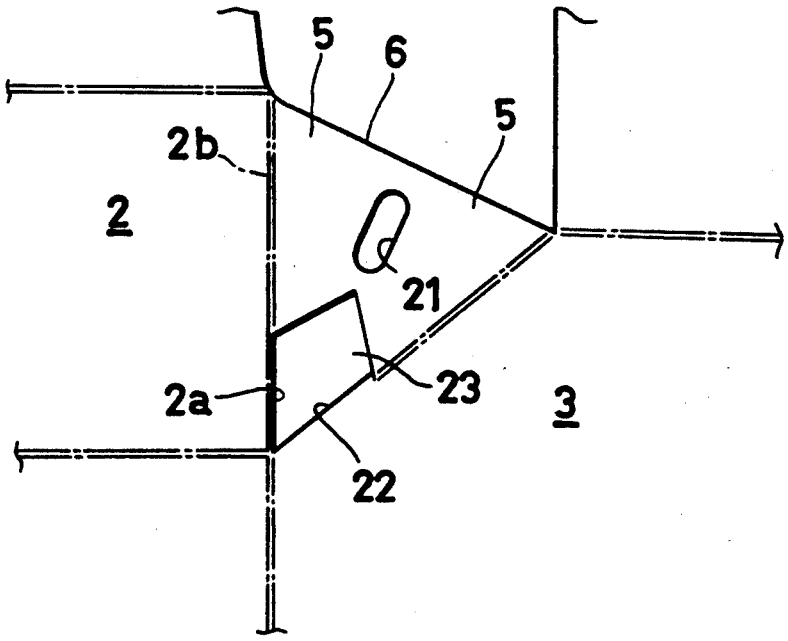
FIG. 10 illustrates a foldable portion with no folding line.

FIGS. 5, 6 and 7 show other embodiments. In the FIG. 5 embodiment, a foldable portion 6 has a V-like upper edge 21' which is stamped out together with cutout 23.

In the embodiment of FIG. 6, an I-like cut 21 is formed along the folding line 18. By folding the foldable portion 6, the I-like cut is changed so as to avoid the metering unit of the cap.

In the embodiment of FIG. 7, cutout 21 and the upper V-like edge 21' of the foldable portion 6 merge into each other so as to form a deep notch. By such shape, the area of the foldable portion is reduced to thereby facilitate folding.

While in the above embodiments the respective cutouts aligning with the corresponding folding lines are provided illustratively, the following points should be considered depending on a carton manufacturing line system used.

Since each foldable portion 6 has the folding line 18, the tilted plate 2 is first folded, starting with the folding line 18 in assembling, so that a repulsive force is likely to be lost in the central part of the foldable portion. Therefore, no collection of stresses occurs which is enough to fold the foldable portion 6 along the folding line 3a between the foldable portion 6 and the front plate 3 (this applies to the rear plate 4 although not shown). Thus, the foldable portion 6 can be folded with an expansion left on the folding line 3a (see FIGS. 8 and 9).

In order to avoid such situation, a cut 21 is required to be provided at substantially the center of the foldable portion 6 in place of forming a folding line in the foldable portion 6. Thus, when the tilted plate 2 is folded, each foldable portion 6 is bent (see phantom lines in FIG. 8), stresses are collected on the folding line 3a to thereby impair no appearance of the container, as shown in FIG. 4.

Also, in this case, the configuration of the cut is not restricted, as in the embodiments.

Figure 11:
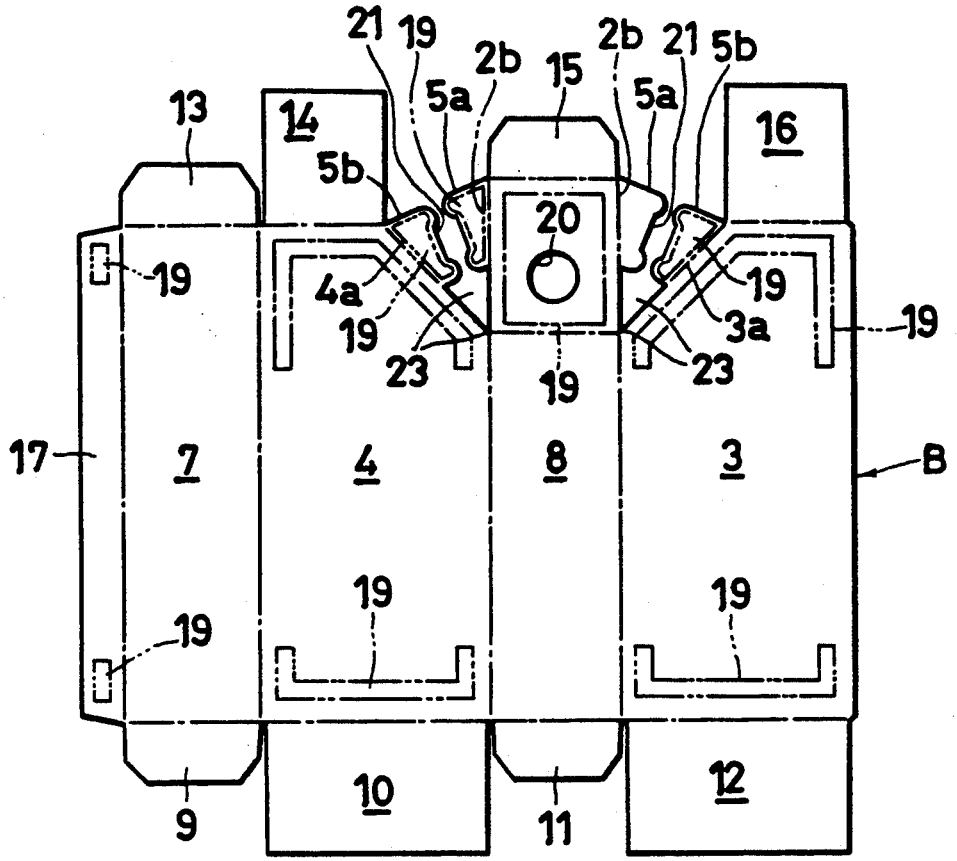
FIG. 11 illustrates a blank of an embodiment where the divided foldable portions are provided.
Figure 12:
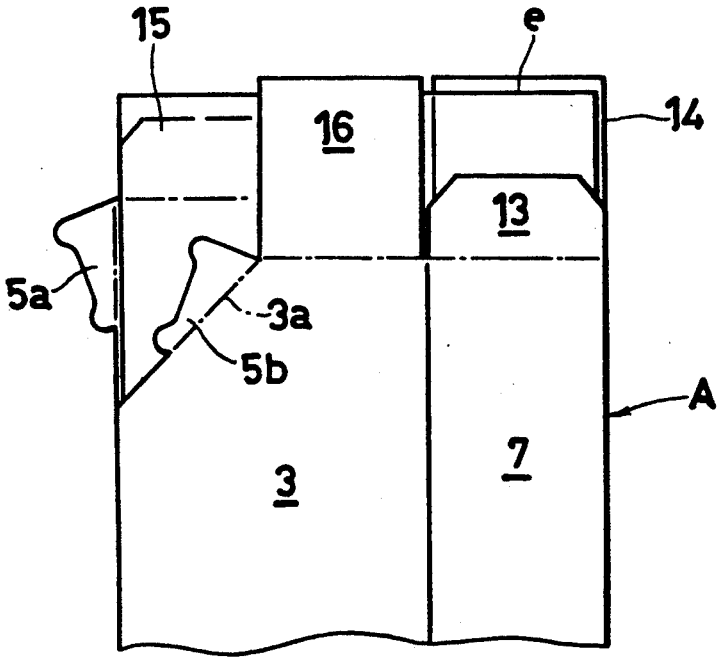
FIG. 12 illustrates a sleeve-like carton (when folded flat) of the embodiment with the divided foldable portions.
Figure 13:
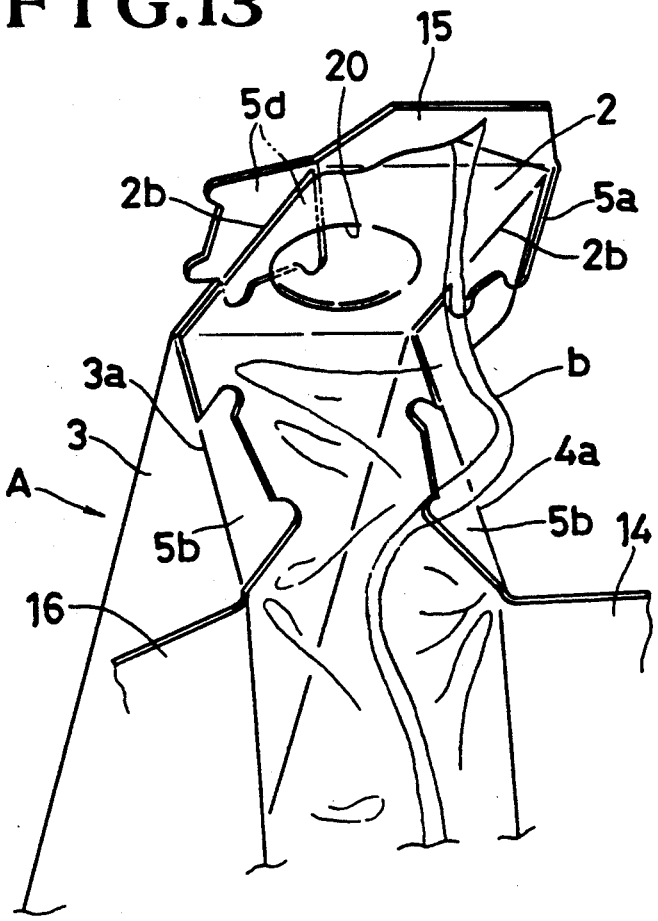
FIG. 13 illustrates folding of the upper side tilted plate.

Measures to prevent bad folding of each foldable portion may be employed, as illustrated in the next embodiment. As shown in FIGS. 11–13, the foldable portion 6 is divided by a cut 21 into a flap 5a continuous to a side (folding line) 2b of the tilted plate 2 and a flap 5b continuous to each of the upper tilted sides (folding lines) 3a, 4a of the front and rear, plates 3 and 4 with the cutout 23 being continuous to the cut 21.

As shown in FIG. 12, the flap 5a of the tilted plate 2 folded when the carton is flat is not bonded to the inner bag tube e (bonding the inner bag tube to the blank to make the container will be described in detail later). While the flap 5a positioned on the opposite side is shown as being bonded to the inner bag tube e, it is not necessarily required to be done so. The flaps 5b on the front and rear plates 3 and 4 are bonded to the inner bag tube e.

Since the flaps 5a are not bonded to the inner bag tube e, as mentioned above, the flaps 5a do not cause inter-layer separation even if the carton with the inner bag tube is pressed flat. The other flap 5a and 5b are bonded to the inner bag tube e to thereby guide the tube e satisfactorily when folded.

As shown in FIG. 13, when the tilted plate 2 is folded, the flaps 5a, 5b are folded by abutting easily against guides (not shown). At this time, the flaps 5a and 5b are foldable separately, so that stresses are easily collected on the side edge 2b and on the tilted side edge 3a, 4a as the base ends of the flaps 5a, 5b, respectively, to thereby ensure folding without leaving no repulsive force. Therefore, even if the flaps 5a and 5b contact in plane, the return force of the flaps 5a is small and does not push the tilted plate 2 upward. Therefore, no spacing is produced between the side edge 2b of the tilted plate 2 and the tilted side edges 3a, 4a of the front and rear plates 3 and 4 to thereby impair no appearance of the thus formed outer box. Since the flaps 5a and 5b are separated when the blank is expanded, folding the flaps does not push out or break the corresponding inner bag tube e.

By bonding the facing flaps 5a and 5b with a bond, the tilted state of the tilted plate 2a is maintained more satisfactorily.

Figure 14:
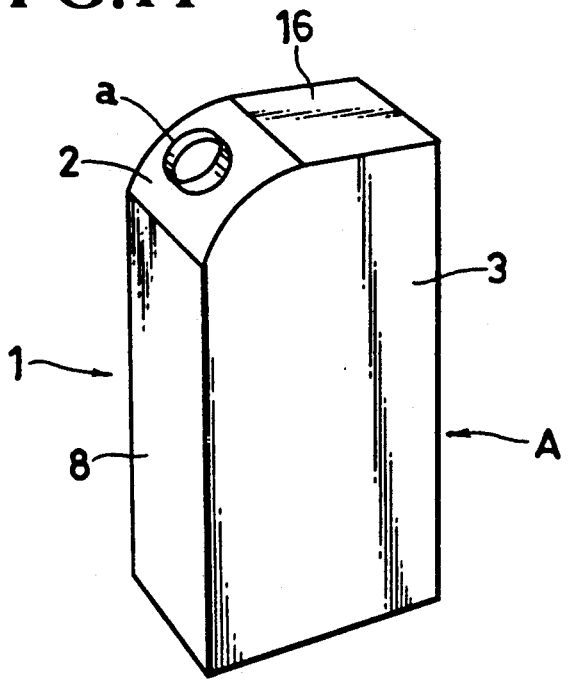
FIG. 14 illustrates a container with a curved tilted plate having a spout.
Figure 15:
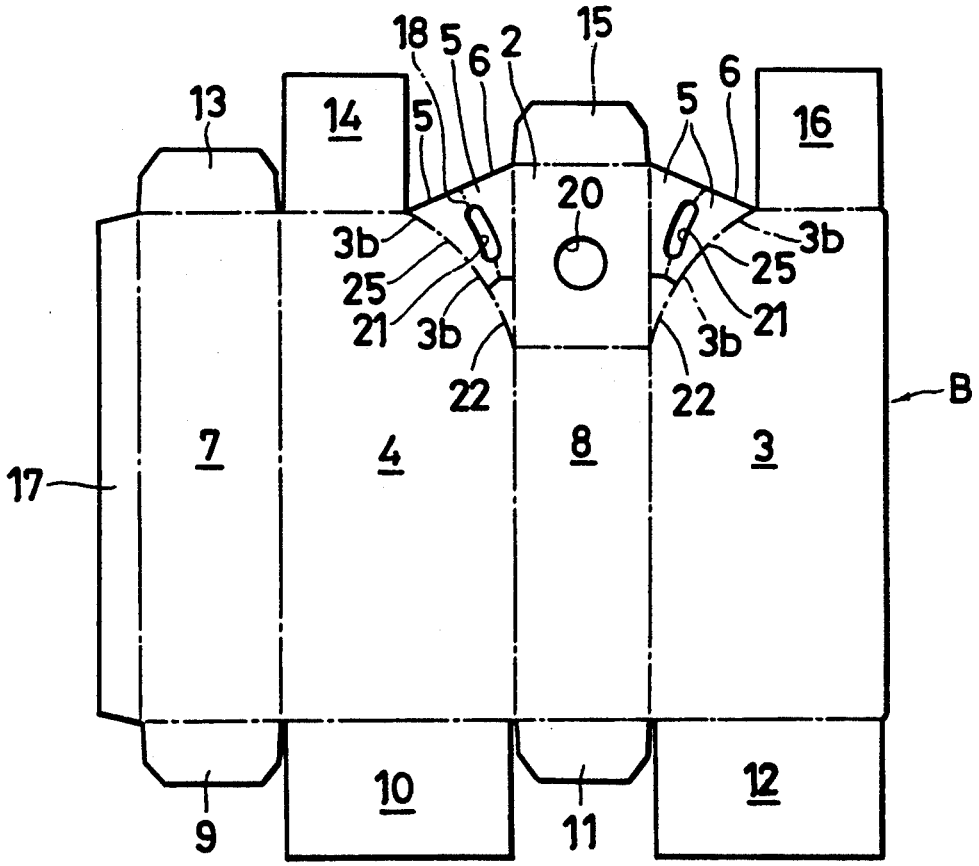
FIG. 15 illustrates an expansion of the FIG. 4 container.

FIG. 14 shows a liquid container 1 with a curved tilted plate 2, i.e., an example of a container made of outer flat surfaces except a partial non-flat surface. In this embodiment, as shown in the blank of FIG. 15, an arcuate edge of an overhanging part 22, each of arcuate side edges (folding lines) 3b, 4b, and an arcuate cut 25 positioned on that of these edges 3b, 4b are continuous to form the same curve. Provision of the cut 25 allows the arcuate edges 3b, 4b to be folded naturally when the foldable portions 6 are folded to thereby allow the tilted plate 2 to be folded in a curved state.

As mentioned above, the container 1 has the cutout 21 in the foldable portion 6 positioned between the tilted plate with the spout a and each of the front and rear plates 3, 4, so that the foldable portion 6 is easy to fold and there is no interference between the metering unit d of the cap c and the foldable portion 6. Even if the diameter of the metering unit is large, a cap with the metering function can be set to a container with such carton structure.

While in the above embodiment the bonding region 19 where the carton barrel and the inner bag are bonded are formed as a thin strip one (continuous), the following points should be considered. When this container is exposed to an external impact, for example, occurring when it falls, the impact force would directly act on the inner bag without being distributed to thereby possibly break the bag, starting from a point on the bag where the impact force acted because the carton and the inner bag are bonded in a thin strip region.

Figure 16:
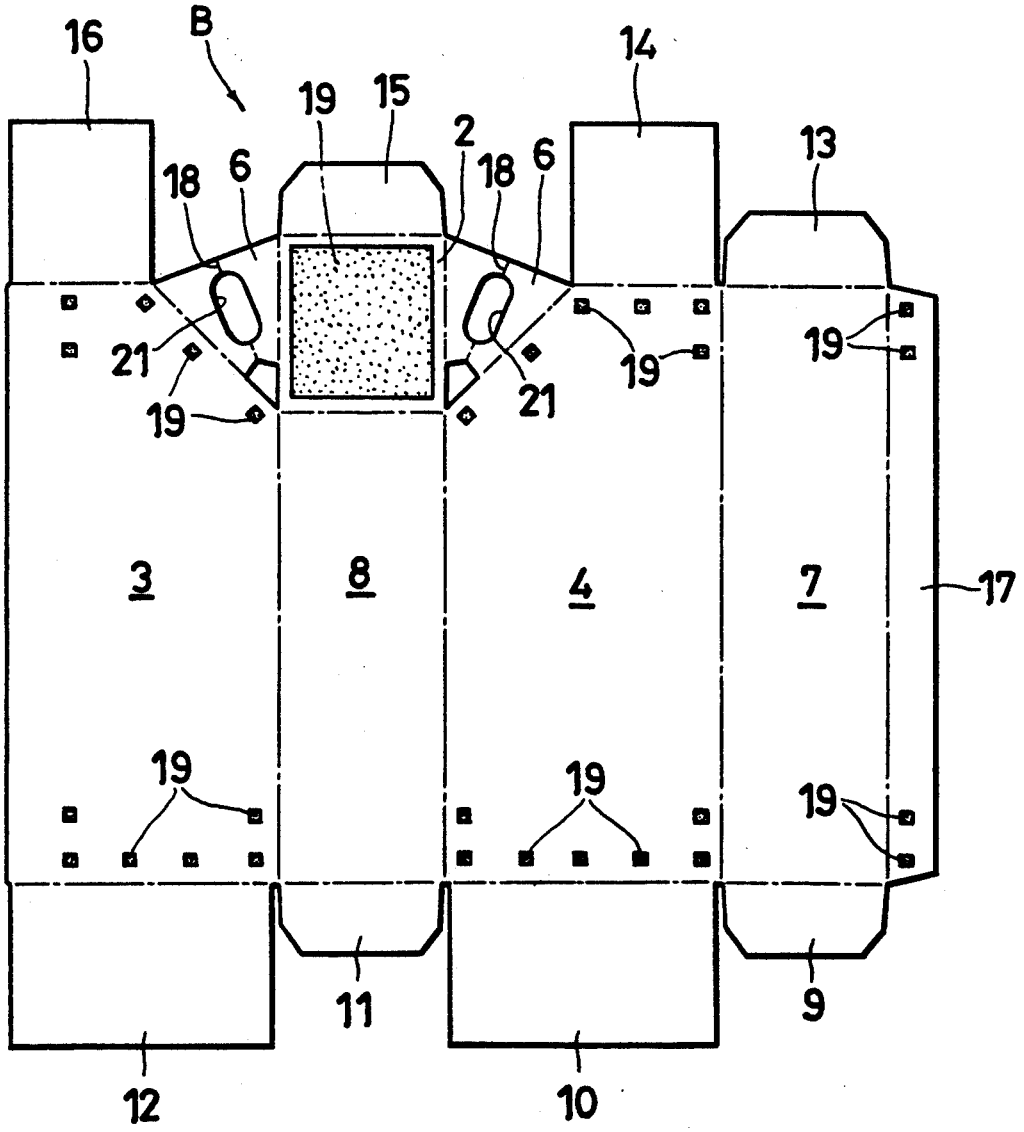
FIG. 16 illustrates an embodiment with distributed bonding regions.

The next embodiment proposes a container which has the function in which the inner bag is not broken by such impact force, for example, occurring when it falls. As shown in FIG. 16, a plurality of distributed substantially square bonding regions 19 is provided on each of upper and lower inner surface portions of the front and rear plates 3, 4, and the overlap width 17, where the carton A and the inner bag are bonded. Since the inner bag is folded inwardly at the tilted plate 2, no collection of the impact forces occurs in the regions 19, so that inner bag can be provided in the conventional manner on the inner surface of the tilted plate.

A liquid container having conventional linear bonding regions and an inventive container of the embodiment just mentioned were subjected to a falling test. The results of such test are shown in Table 1 below.

TABLE 1

| | Conventional liquid container | Inventive liquid container |
|---|---|---|
| Samples 1 | A total of 5 bags (samples 1) were broken when fell once. | None of a total of 5 bags (samples 1) were broken when fell. |
| Samples 2 | 3 of a total of 5 bags (samples 2) were broken when fell once. | None of a total of 5 bags (samples 2) were broken when fell. |

The layered structure of the inner bags of the tested samples 1 and 2 is as follows:

The tested sample 1: polyester (outer)/polyethylene (inner)

Tested sample 2: nylon (outer)/polyethylene (inner)

The falling distance of the samples was one meter. In each test, five tested samples 1 and five tested samples 2 were used. The bonding regions were all 5×5 mm square.

By the falling test, it was found that provision of small distributed bonding regions was very advantageous to prevent the breakage of the bag.

As mentioned above, the bonding regions for the carton and the inner bag are small and distributed, so that even if the carton is subjected to an external impact, the inner bag is only changed slightly at its non-bonding regions to thereby prevent collection of the impacts to a local point on the bag to thereby prevent the breakage of the bag. This embodiment can easily prevent the breakage of the inner bag without improving the strength of the bag material. Even if the bag-in-box container is subjected to an external force due to falling or impacts and hence the carton is deformed, the inner bag is not broken and the resistance of the bag-in-box container to impacts are improved. Selection of a carton material contributes to the resistance of the bag to breakage. The material may have a layered composition of polyester (outer)/nylon/polyethylene (inner). Alternatively, it may have a layered composition of polyester (outer)/SiO/polyethylene (inner) in view of a gaseous barrier property.

Figure 18:
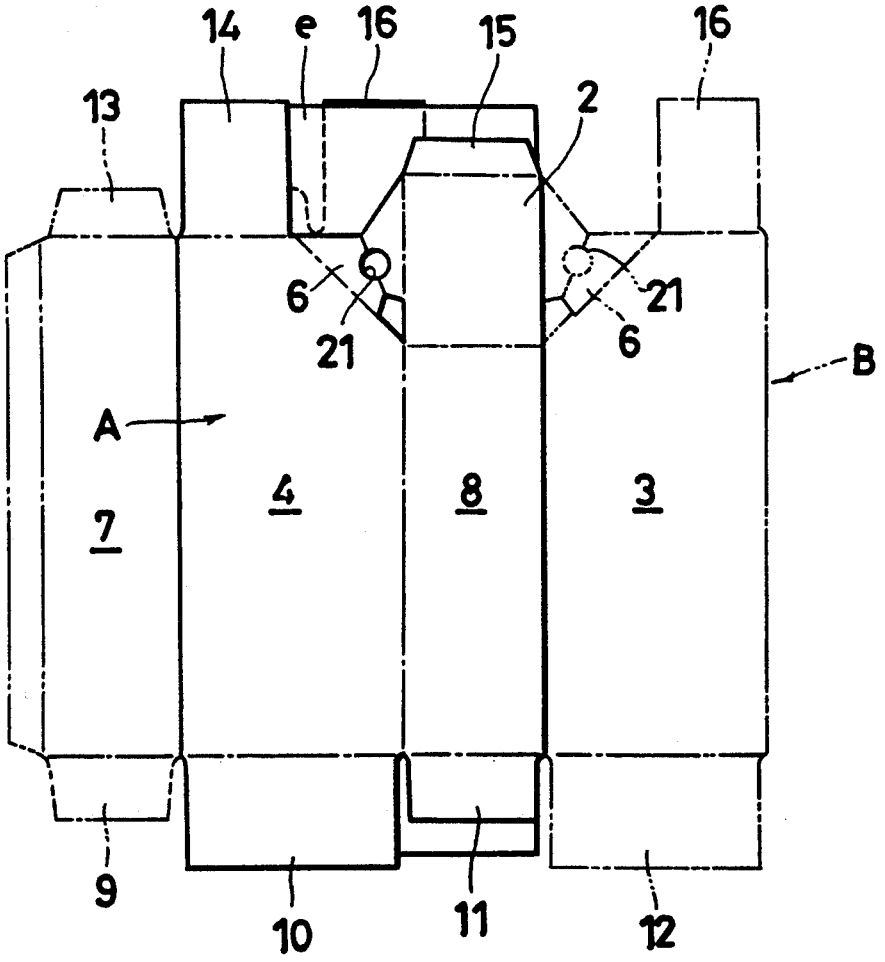
FIG. 18 illustrates a flat sleeve-like carton formed by bonding.
Figure 19:
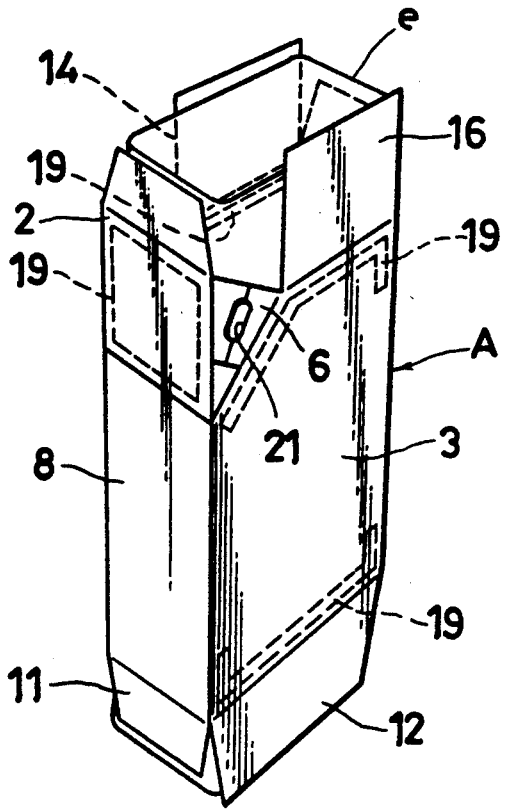
FIG. 19 illustrates a cylindrical carton.
Figure 20:
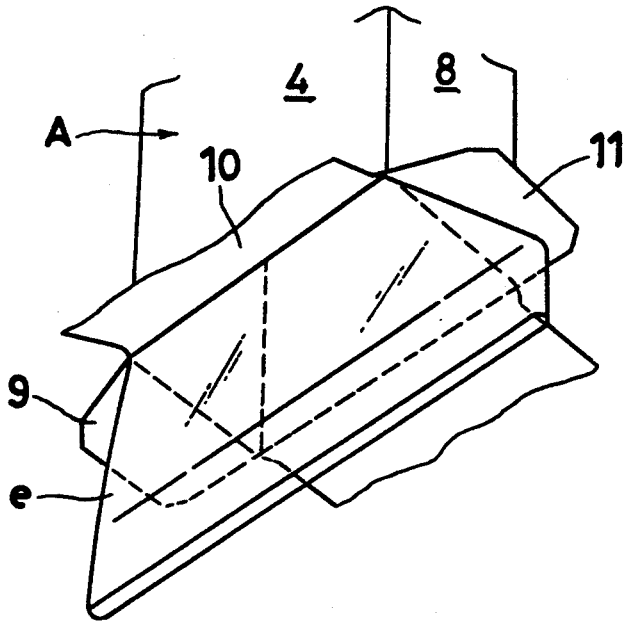
FIG. 20 illustrates a lower heat sealed end of the internal bag forming tube.

A method of making such container according to the present invention will be described below. For example, continuous bonding regions or distributed bonding regions are provided on a blank B stamped out as shown in FIG. 1. An internal bag tube e is disposed on this blank. The tube e and blank B are bonded at the bonding regions and further the blank is bonded at the overlap width 17 to provide a flat sleeve-like carton A (FIG. 18).

This flat sleeve-like carton is raised in the box making/filling line so as to be cylindrical (FIG. 19) and closed so as to form the carton bottom. In this bottom forming, a lower end of the inner bag tube is heat sealed (FIG. 20), and the resulting sealed lower end and the bottom flaps are folded and bonded. The upper side tilted plate of the carton having an open upper end is stamped out together with the inner bag tube to form an opening, to which a spout is welded by supersonic welding.

Figure 32:
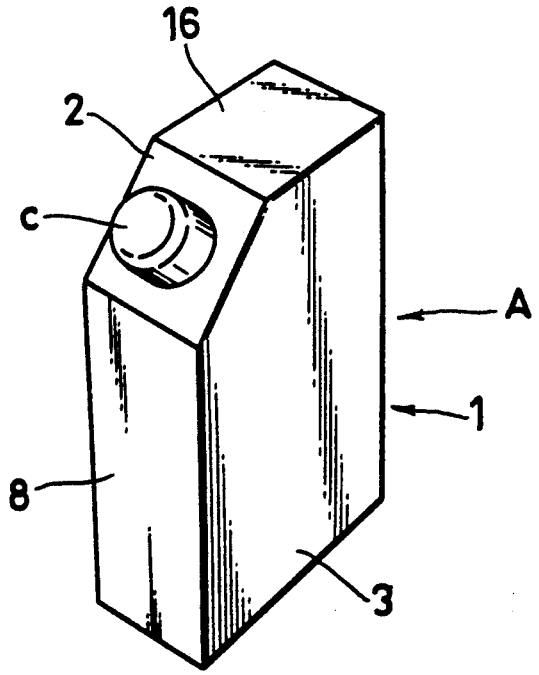
FIG. 32 is a perspective view of the liquid container.

When the spout is attached, the upper end of the tube is heat sealed. The foldable portions are then folded inwardly while the upper tilted plate is being folded, and the upper flaps are also folded and bonded to form the upper closed end. A required liquid is then filled into the bag through the spout and capped to provide a liquid filled container (as in FIG. 32).

In addition to such filling process, a carton with an open end can be filled with a required liquid through the open end thereof. In this case, a spout with a cap is attached and welded to the opening formed by stamping. A liquid is filled into the upper open carton from above and the upper end of the carton is then closed.

As mentioned above, in the formation of the closed bottom of the carton, the bottom flaps are folded. A hot melted bond is coated on the last bottom flap to be folded, and then the flaps are bonded. In this case, there is a possible difference or spacing in height between the first folded bottom flap and the bottom flaps on both the sides folded so as to be superimposed on the first-folded bottom flap. Thus, the bonded planes do not share the interface and bad bonding would occur.

Figure 21:
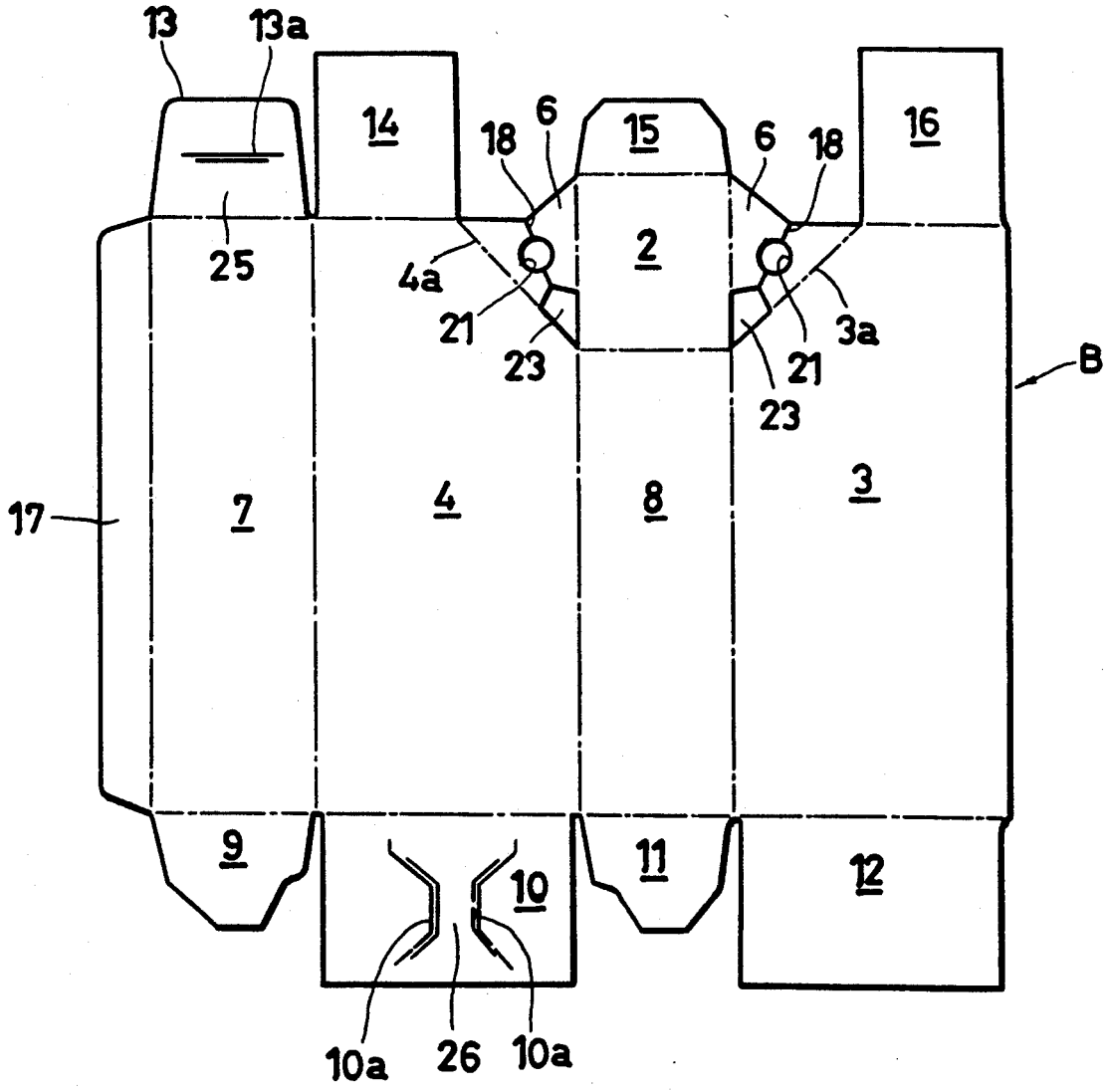
FIG. 21 illustrates an embodiment with an embossment provided at a bottom flap.

In order to avoid such situation, the following steps are taken. As shown in FIG. 21, the top flap 13 continuous to the upper end of the side plate 7 of the blank B has an embossment 25 ranging from the upper edge of the side plate 7 to a line segment 13*a* such that when the top flap 15 continuous to the upper end of the tilted plate 2 is superimposed on the flap 13, no step difference is produced therebetween.

Figure 22:
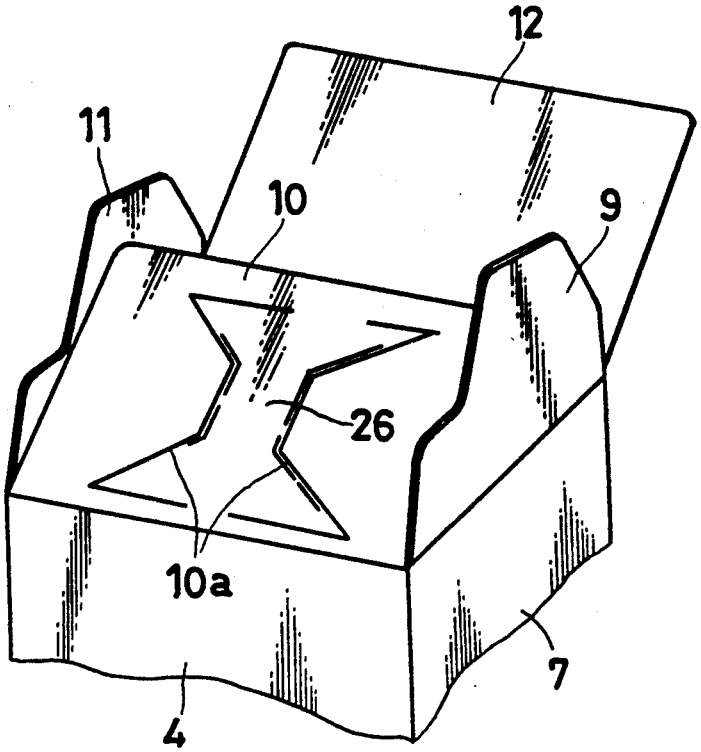
FIG. 22 illustrates how the bottom flap with an embossment is folded.
Figure 23:
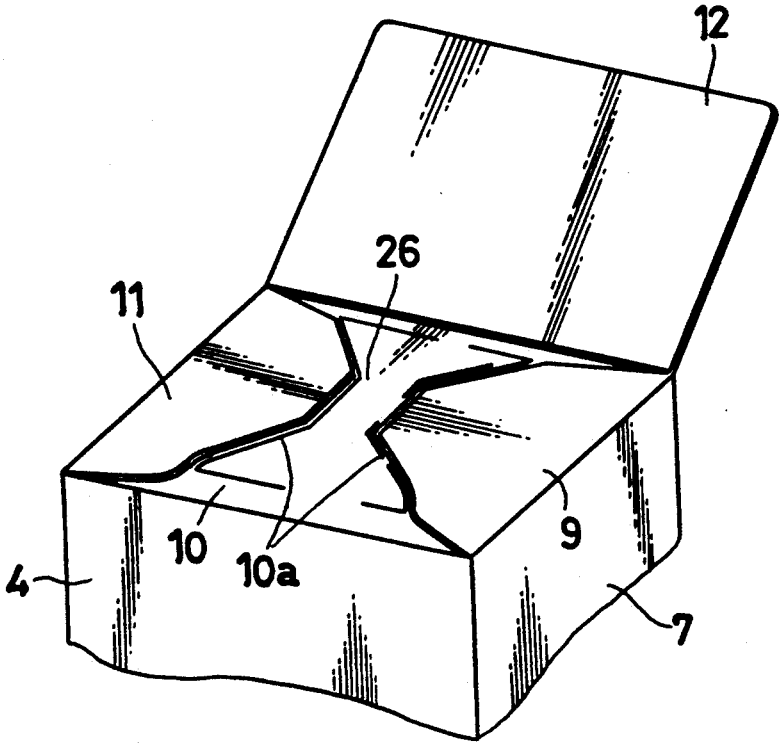
FIG. 23 illustrates a bottom flap with an embossment and bottom flaps on both sides of the former flap being folded and superposed on the former flap.

The bottom flap 10 continuous to the lower end of the rear plate 4 is a flap folded first when the bottom is closed and formed, and bottom flaps 9, 11 positioned on both the sides of the flap 10 are folded on the bottom flap 10. An embossment 26 is provided which is raised outwardly and divergent toward upper and lower ends of the bottom flap 10, as defined by line segments 10*a* coincident with the end configuration of the bottom flaps 9, 11. As shown in FIGS. 21, 22, when the bottom flap 10 is folded inwardly, and then the bottom flaps 9, 11 on the both sides of the bottom flap 10 are folded and superimposed on the bottom flap 10, there is no difference in height between the bottom flaps 9, 11 and the upper surface of the embossment 26 of the bottom flap 10 because of the existence of the embossment 26 when the bottom of the carton A is assembled. Therefore, the adhesion of the last bottom flap 12 superposed and bonded is sufficiently satisfactory. Therefore, the strength of the carton against impacts due to falling is greatly improved. For example, if a liquid filled container is dropped by mistake, there is no leakage of the liquid in the carton which would otherwise occur because of breakage of the bottom of the carton due to the impact. In addition, there is no spacing between the bottom flaps 10 and 12, so that the container exhibits an improved appearance and, when placed, improved stability.

Figure 24:
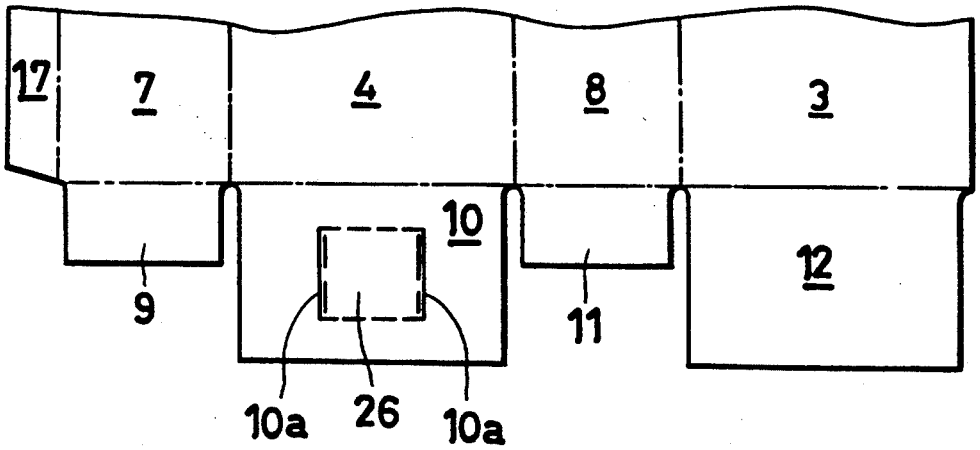
FIGS. 24, 25 and 26 illustrate embossments having other shapes.
Figure 25:
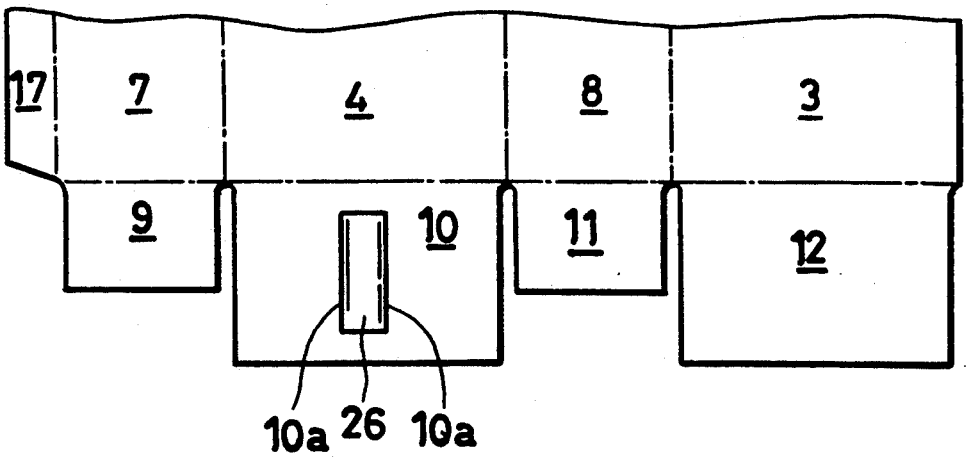
Figure 26:
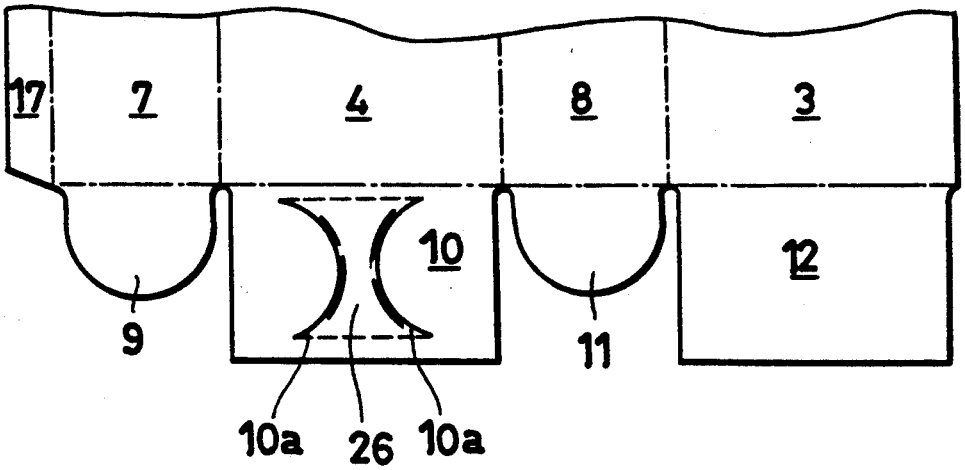

FIGS. 24–26 shows other embodiments where the shape of an embossment 26 on the bottom flap 10 is determined in conformity to the shape of the ends of the bottom flaps 9, 11. In the embodiments of FIGS. 24 and 25, a rectangular embossment 26 is provided corresponding to the bottom flaps 9, 11 having a linear edge. In the embodiment of FIG. 26, an hourglass-like embossment 26 defined by opposite arches 10*a* is provided in correspondence to substantially semi-circular bottom flaps 9, 10. In any one of those aspects, when the bottom flaps 9, 11 are folded and superimposed on the bottom flap 10, the embossment 26 and bottom flap 9 and 11 share the same plane to thereby provide excellent adhesion.

Figure 17:
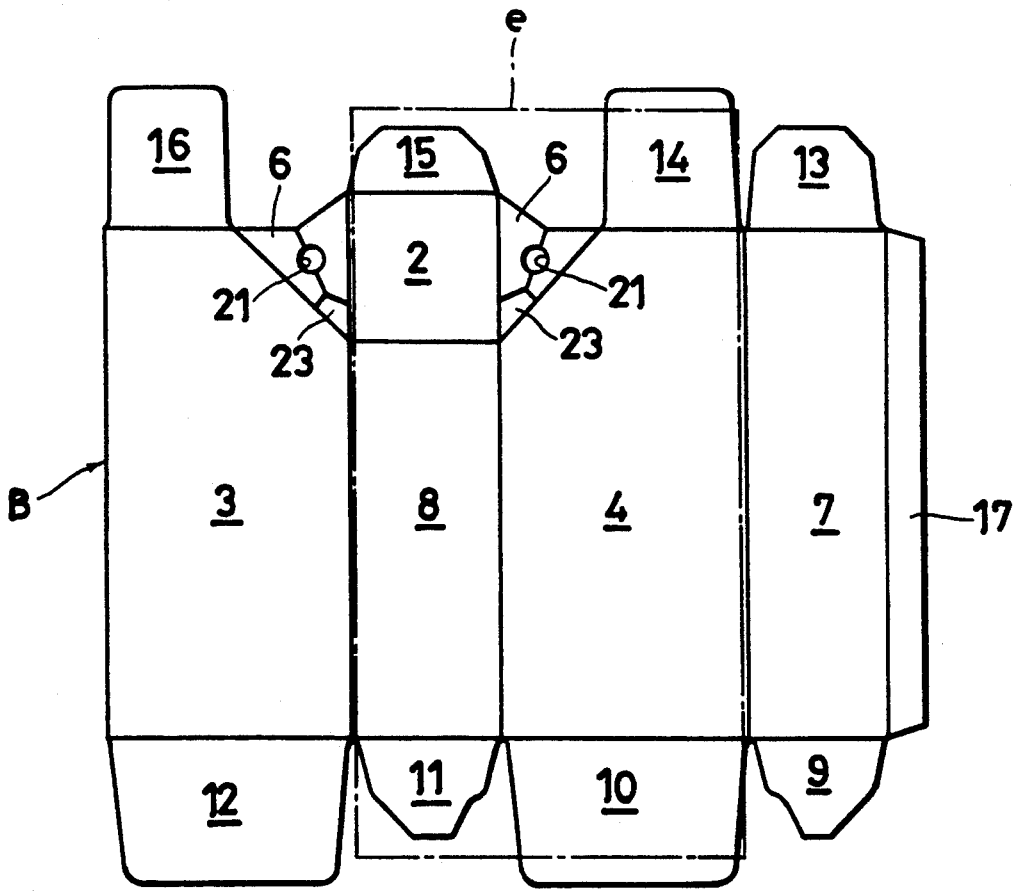
FIG. 17 illustrates an internal bag tube provided on the blank.

As mentioned above, when a liquid container is to be made, a bond is applied to the stamped out blank at its boding regions. An inner bag forming tube is then disposed, and the blank is bonded at its overlap width to provide a flat sleeve-like carton (FIGS. 17 and 18). In the course of bonding at the overlap width, if the tube is bonded to the inner carton surface at a position deviating from the correct position, catching and/or bad sealing of the bag tube are likely to occur in the subsequent box-making line. Therefore, it is required to inspect the bonded position of the tube relative to the blank and eliminate a bad article, if any, in the delivery section which performs the final bag bonding step. Inspecting the position of the tube is performed by metering the bonded position of the tube of the pulled-out article using a scale.

This process using a scale requires labor and time and comprises determining whether the position of the tube bonded to the blank is satisfactory, using three register line segments printed on each of both side edges of each of the top and bottom flaps and indicative of the correct bonding positions and printed when a pattern is printed on the blank. However, in this process, when the printed pattern and the stamping position deviate in register from each other, the register lines themselves deviate from the correct bonding positions on the tube to thereby become no correct reference for alignment.

In order to avoid such undesirable situation, the following measures are taken.

Figure 27:
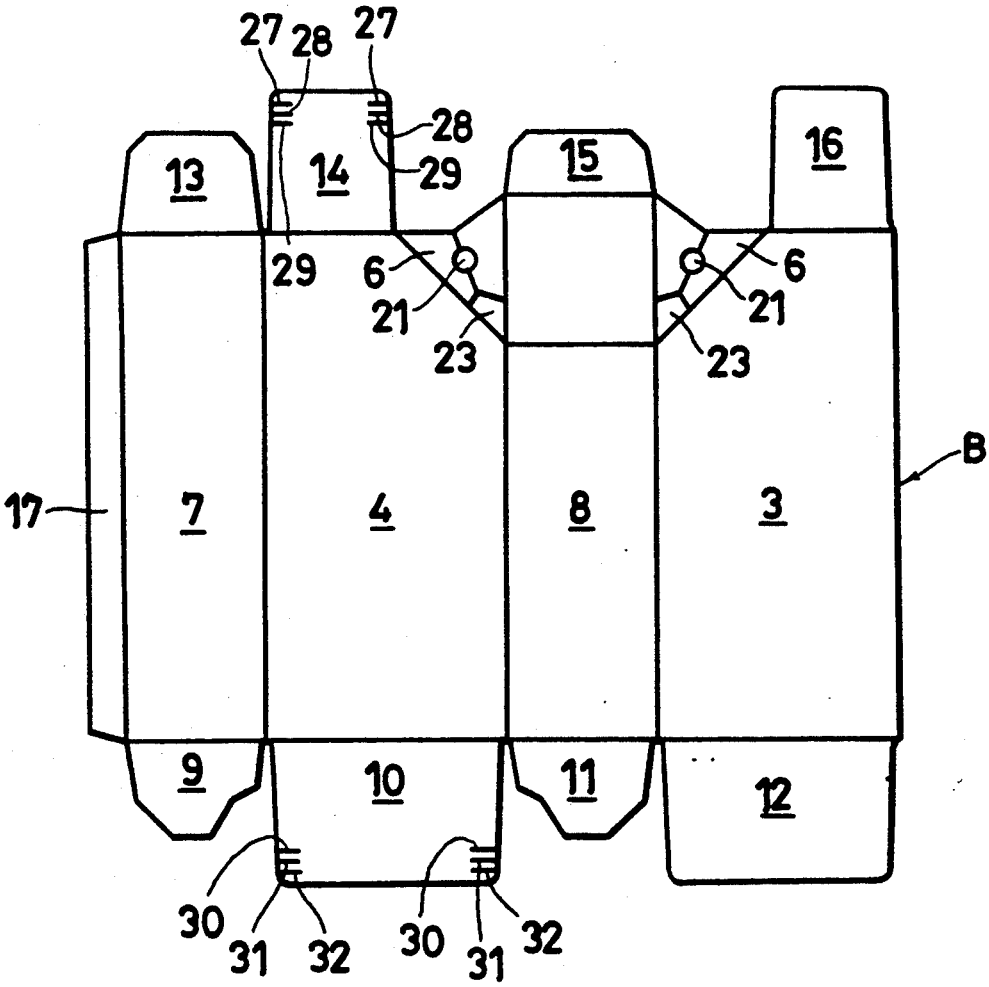
FIG. 27 illustrates a blank with line segment marks.

As shown in FIG. 27, three line segment marks 27, 28, 29 indicative of an upper limit, middle position and lower limit of an allowable range of the upper position of the tube relative to the blank (carton) are provided on both upper side edges of the top flap 14 continuous to the upper end of the rear plate 4. Further, line segment marks 30, 31, 32 indicative of an upper limit, middle position and lower limit of an allowable range of the lower end position of the tube relative to the blank (carton) are provided on both lower side edges, of the bottom flap 10 continuous to the lower end of the rear plate 4.

Figure 28:
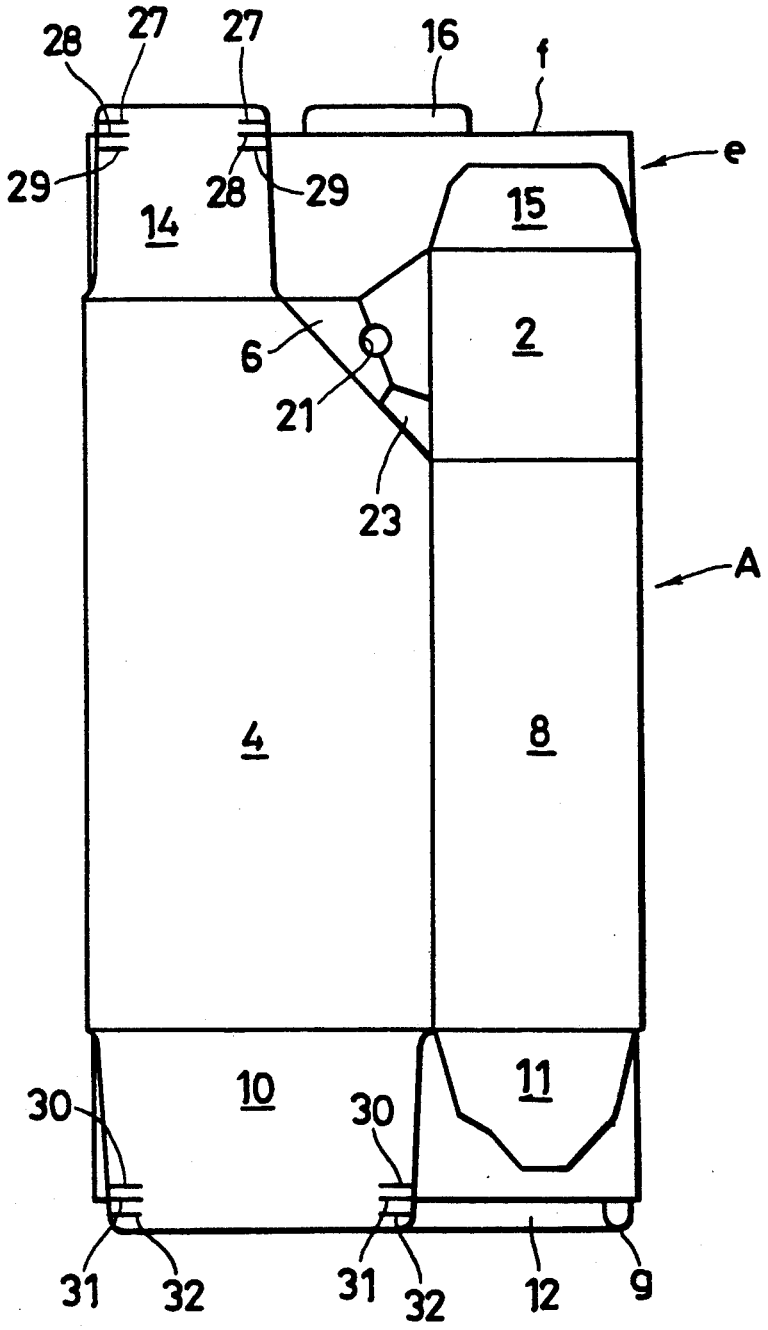
FIG. 28 illustrates the positional relationship between line segment marks and upper and lower edges of the inner bag forming tube in a flat sleeve-like carton.
Figure 29:
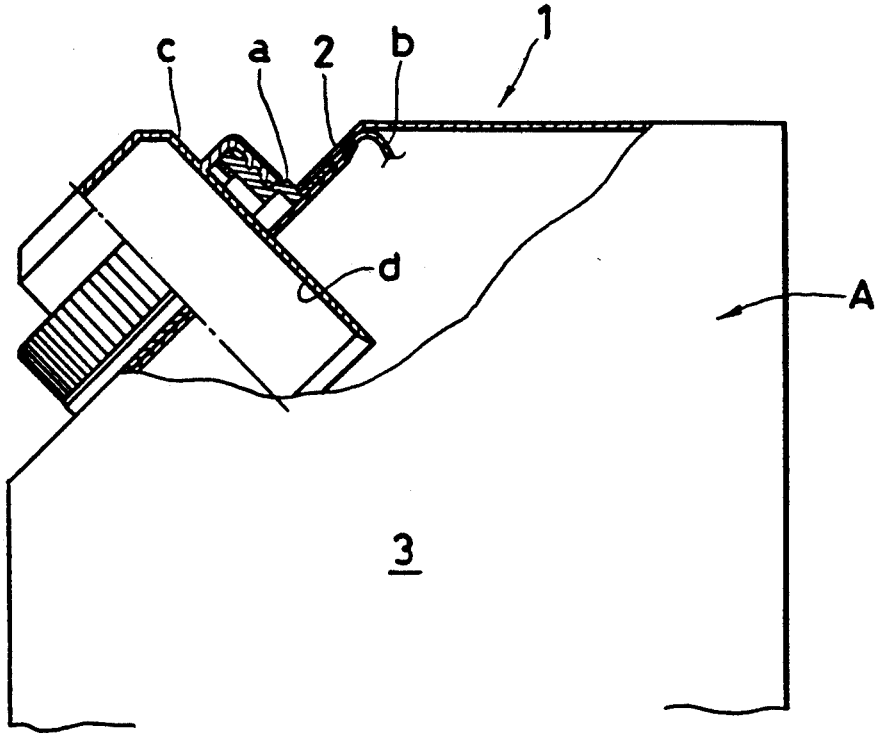
FIG. 29 illustrates a partially cutaway conventional liquid container.
Figure 30:
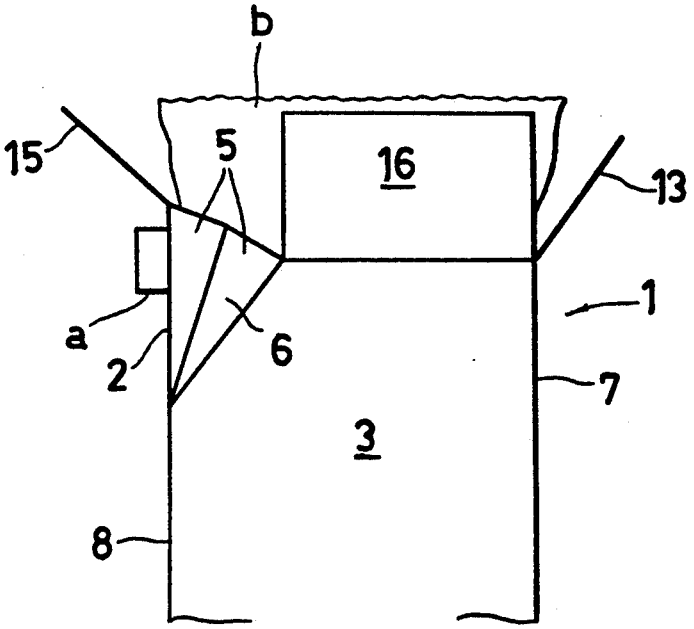
FIG. 30 illustrates a conventional liquid container with an upper end open.
Figure 31:
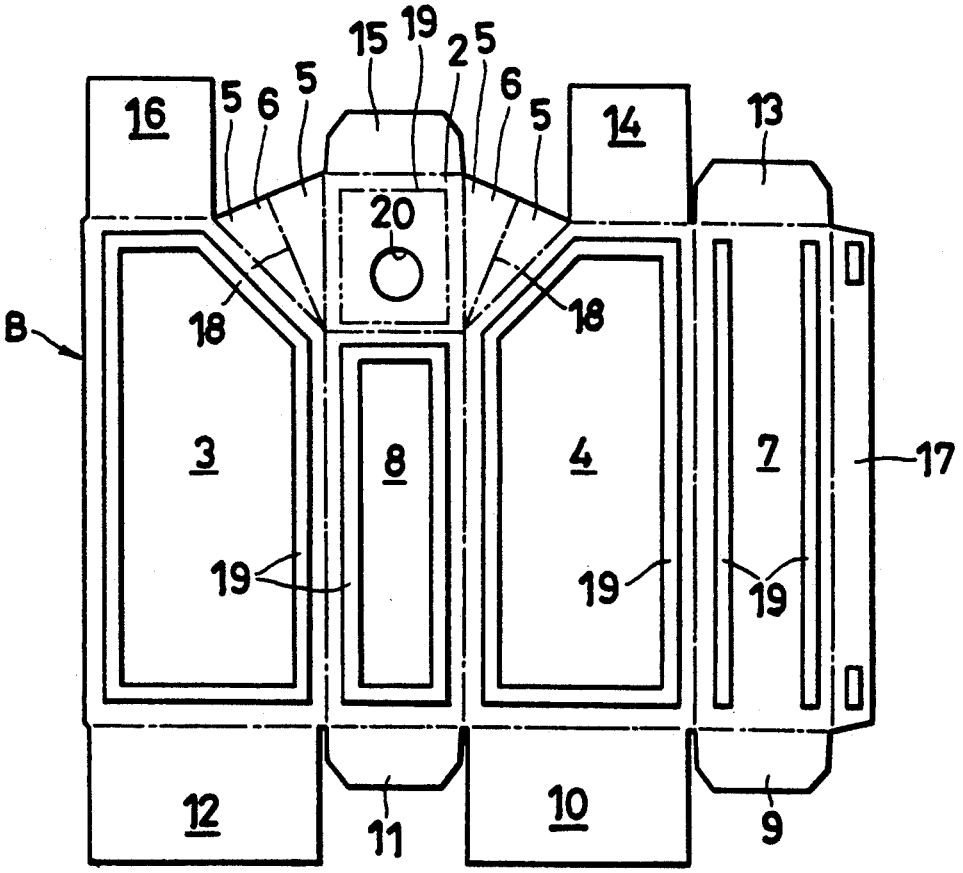
FIG. 31 illustrates a blank of the conventional liquid container.

When the tube e is bonded to the blank with the line segment marks and the blank is bonded at its overlap width to thereby form a sleeve-like carton A, the tube e appears partially from both side edges of each of the top and bottom flaps 14 and 10, as shown in FIG. 28, so that the positional relationship of an upper end f of the tube e relative to the line segment marks 27, 28, 29 and the positional relationship of the lower end g of the tube relative to the line segment marks 30, 31, 32 can be confirmed. More specifically, as a result that the tube was bonded to the blank having the line segment marks to thereby form a sleeve-like carton, the bonded position of the tube was visually inspected and bad articles were picked away successfully in the delivery section for the overlap width bonding process. This process does not take labor and renders the working very simple compared to the conventional process using the measurement. This process using the line segment marks is not required to consider a deviation between the stamping position and the printing position compared to the process using printing registers.

The line segment marks provided on the blank is formed simultaneously with the stamping of the blank using a cutter provided on the stamping die, so that no deviation of the tube from the blank (carton) occurs.

When the liquid container is manufactured in accordance with the above manufacturing steps including attaching a spout to the carton selected by the inspection based on the line segment marks., no catching of the container due to the tube in the box manufacturing and filling lines occurring. Nor did bad sealing occur. In the above embodiments, line segment marks were provided on the top and bottom flaps folded inwardly and were hidden when the top and bottom were closed.

As mentioned above, three line segment marks indicative of an allowable range of the upper and lower positions of the inner bag forming tube are provided, so that it is easily determined whether the bonding position of the tube is satisfactory or not and it can be inspected simultaneously whether the tube is too short or long or is bent. Since the position of the line segment marks relative t the blank is absolutely correct, the positions of the upper and lower ends of the tube can be detected by electrical detecting means comprising a sensor without using vidual inspection.

What is claimed is:

1. A liquid container comprising:

a carton including a front plate, a rear plate, a pair of side plates each connecting adjacent side edges of said front and rear plates, and an upper side tilted plate having an aperture therein;

an inner bag disposed in said carton;

a spout protruding outward from said upper side tilted plate through said aperture;

a pair of foldable portions each disposed between said upper side tilted plate and each of said front and rear plates, each foldable portion having a cutout aligned with said aperture.

2. A liquid container according to claim 1, wherein each said foldable portion has a folding line extending through its cutout.

3. A liquid container according to claim 1 or 2, wherein said upper side tilted plate curves outwardly from said carton.

4. A liquid container according to claim 1 or 2, wherein said foldable portion comprises a pair of flaps divided by said cutout, one flap being continuous to said upper side tilted plate and the other flap being continuous to each of said front and rear plates.

5. A liquid container according to claim 1 or 2, comprising distributed small bonding regions for said carton and inner bag.

6. A liquid container according to any one of claims 1 or 2, further including: at least one top flap forming a portion of the top of said carton and at least one bottom flap forming a portion of the bottom of said carton, and each having three line segment marks indicative of an upper limit, a middle position and a lower limit of an allowable range of the upper and lower positions of an inner bag forming tube bonded to said carton, said carton being made of a blank and taking the form of a sleeve formed by bonding.

7. A liquid container comprising a sleeve-like carton which includes a blank an inner bag tube attached to the blank at least one top flap forming a portion of the top of said carton and at least one bottom flap forming a portion of the bottom of said carton, each having three line segment marks indicative of an upper limit, a middle position and a lower limit of an allowable range of the upper and lower positions of an inner bag forming tube bonded to said carton, said carton being made of a blank and taking the form of a sleeve forming by bonding.

* * * * *